United States Patent [19]

Bridges et al.

[11] Patent Number: 4,600,356

[45] Date of Patent: Jul. 15, 1986

[54] UNDERGROUND PIPELINE AND CABLE DETECTOR AND PROCESS

[75] Inventors: Jack E. Bridges, Park Ridge; Robert J. Sutkowski, Chicago; Kenneth E. Hofer, Jr., Chicago Ridge, all of Ill.

[73] Assignee: Gas Research Institute, Chicago, Ill.

[21] Appl. No.: 574,568

[22] Filed: Jan. 27, 1984

[51] Int. Cl.[4] ..... E02D 17/00

[52] U.S. Cl. ..... 414/694; 414/699; 37/DIG. 1; 37/DIG. 19; 172/6; 324/329

[58] Field of Search ..... 414/699, 694; 37/DIG. 1, DIG. 19; 324/329, 326, 67; 172/6

[56] References Cited

U.S. PATENT DOCUMENTS

| | | | |
|---|---|---|---|
| 3,858,737 | 1/1975 | Senoo | 414/699 |
| 3,907,136 | 9/1975 | Christides et al. | 414/699 |
| 4,006,481 | 2/1977 | Young et al. | 324/329 |

FOREIGN PATENT DOCUMENTS

| | | | |
|---|---|---|---|
| 1443925 | 7/1976 | United Kingdom | 324/329 |
| 2041532 | 9/1980 | United Kingdom | 324/329 |

*Primary Examiner*—Andrew M. Dolinar
*Attorney, Agent, or Firm*—Thomas W. Speckman

[57] ABSTRACT

An apparatus and process combining an excavation apparatus with a fully contained underground elongated conductive object detector capable of selectively detecting underground objects such as water pipes and electrical cables. The combination of this invention may be advantageously used in trenching to prevent damage to underground water pipes and electrical cables by detecting their presence before the digging implement damages them. An audible or visual signal may be activated and/or the excavation apparatus may be automatically shut down upon detection of an underground pipe or cable a few feet below the excavation. The detector may be incorporated in the digging shovel of a backhoe or maintained in position adjacent the digging implement by a boom extending from the excavation apparatus. Simple and sturdy time gated electronics is advantageously used to differentiate underground pipes and cables from other underground metal debris and to provide range and direction information.

10 Claims, 10 Drawing Figures

UNDERGROUND PIPELINE AND CABLE DETECTOR AND PROCESS

BACKGROUND OF THE INVENTION

1. Field of the Invention

This invention relates to a pulsed eddy current proximity detector and process for locating sub-surface objects such as pipelines and cables. The pulsed eddy current proximity apparatus and process of this invention may detect the presence, assess the range, and assess the size and direction of an underground pipeline or cable with equipment which may be wholly mounted on earth removal or digging apparatus. The pulsed eddy current proximity detector may have its transmit/-receive coil directly emplaced in or mounted on an excavator implement such as a backhoe bucket to transmit and receive electromagnetic radiation to detect conducting objects prior to contact of the excavator implement with such hidden objects. The apparatus and process very reliably makes such detections and may automatically shut down the excavator implement prior to contact with the underground metal object.

2. Description of the Prior Art

A wide number of technologies have been considered for detection of sub-surface or hidden objects. These technologies include nuclear, acoustic, gravitational, magnetic and electromagnetic, such as infrared, microwave and low-frequency magnetic. Both active and passive detection systems have been attempted. Nuclear systems have the inherent safety disadvantages. The desirability of mounting the entire proximity detector on the excavator itself eliminates radar/acoustical, shortwave-longwave or electromagnetic induction active systems. Sonic systems have the disadvantage of being dependent upon good soil contact.

A wide number of metal detectors have been used as buried treasure locators, in geophysical exploration, in law enforcement, and in enhancing airport security. These types of detection devices generally operate to create a near field of continuous wave electromagnetic forces about a central inductive coil. When a metallic object is brought within the field, an impedance change occurs, resulting in the objects detection. Such detectors are sensitive to variations in the soil giving rise to false signals which cannot be tolerated. Further, such detectors do not provide desired discrimination between the desired object, such as a pipe, and debris, such as a metal can. Many continuous electromagnetic wave type detectors are typically constructed having a transmit coil mutually coupled with a receive coil. The requirement of mutually coupled coils inhibits the use and application of these type devices. Because the geometry of the coils are critical for operation, the device must be constructed of rigid members to maintain precise relative coil placement. These type devices are very sensitive to slight jarring or impact which may cause coil movement rendering the device unsuitable for heavy duty applications such as in earth removal operations. Attempts have been made to improve coil arrangements to eliminate the requirement for mutual coupling as taught in U.S. Pat. No. 3,588,687. A more comprehensive review of potential technologies for underground pipeline detectors is set forth in Backhoe Pipeline Damage Prevention by MIDDARS, Jack E. Bridges, Workshop for Gas Distribution and Safety Instrumentation, Kissimmee, Fla., Feb. 1-3, 1983, directed by Institute of Gas Technology for Gas Research Institute and is incorporated herein in its entirety.

More recent efforts to improve upon metal detector sensitivity have been directed to the use of pulsed eddy current detectors in which a pulsed magnetic field is directed toward a target and induces eddy currents in conductive targets. Voltages induced by the decay of the eddy currents are detected. Mutual coupling is not required between the transmit and receive coils. See "Pulse Induction Metal Detector", J. A. Corbyn, Wireless World, Vol. 86, No. 1531 (March 1980) and No. 1532 (April 1980). These articles teach the use of circuitry to eliminate background clutter and noise attributed to the magnetic viscosity properties of earth media and are incorporated herein in their entireties.

SUMMARY OF THE INVENTION

It is an object of this invention to provide a pulsed eddy current detection system capable of detecting the presence, assessing the range, and providing information concerning characteristics, such as pipe diameter, of underground metal objects.

It is another object of this invention to provide a magnetic impulse detection discrimination and ranging system which may be wholly mounted upon an earth excavating device, such as a backhoe.

It is still another object of this invention to provide a magnetic impulse detection discrimination and ranging system which is substantially free from false alarms and may be used to furnish an alarm or to automatically shut down the excavating apparatus.

It is yet a further object of this invention to provide a pulsed eddy current detection system suitable for detection of underground pipelines and cables which is insensitive to varying types of soil and insensitive to the weather.

It is yet another object of this invention to provide an underground pipeline or cable detector which further detects the direction of the located underground object.

Still another object of this invention is to provide a magnetic impulse detection discrimination and ranging system which may be mounted on a standard backhoe with little modification.

These and other objects and advantages of the invention are provided by combining with an excavation apparatus by incorporating into the digging implement, such as a backhoe bucket, or by providing on a boom extending from the apparatus, a coil for transmitting a pulsed magnetic field having a decay time significantly shorter than the decay time of eddy currents induced by an elongated underground conductive object being contacted by the pulsed magnetic field. Elongated, conductive objects, such as thick walled steel or cast iron pipes and sheathed cables, have magnetic field enhancing properties which significantly lengthen the decay time of the induced eddy currents, thereby making detection of the elongated pipeline or sheathed cable more readily discernable over eddy currents induced by metallic debris, such as tin cans. This property makes electronic time gating an effective discriminator against the transmit signal and against metallic debris. Pulsed transmit magnetic field decay times in the order of less than 100 microseconds are suitable and result in eddy current decay times in the order 10 times and more greater when induced by the desired elongated underground object. The eddy current fields are sensed by a time gating circuit which eliminates effects of the exitation field and the effects of eddy currents induced by underground objects having decay times less than a pre-selected minimum. The excavating apparatus may provide power for an electrical pulse source which pulse may be readily transmitted to the transmit coil in the excavation implement portion of the apparatus or on a boom extending from the apparatus to transmit a pulsed magnetic field outwardly through the ground in the direction of desired excavation. A receive coil may be mounted directly in the excavation implement portion of the apparatus or on a boom extending from the apparatus and receive eddy currents induced by an underground conductive object and transmit an electrical signal proportionate to the eddy currents to simple and sturdy signal processing equipment which may be mounted directly on the excavation equipment. The distance of the underground object from the excavation implement may be analyzed by divergence of sensed eddy current fields. Spaced receive coils on the excavation apparatus may be used to determine the direction of the underground conducting pipe or cable. The system of this invention requires little operator assistance and is capable of automatically terminating excavation when target objects are detected.

BRIEF DESCRIPTION OF THE DRAWING

The above and other objects and advantages of the invention will become more apparent upon reading the detailed description of preferred embodiments together with the drawings in which.

DESCRIPTION OF PREFERRED EMBODIMENTS

Figure 1A:
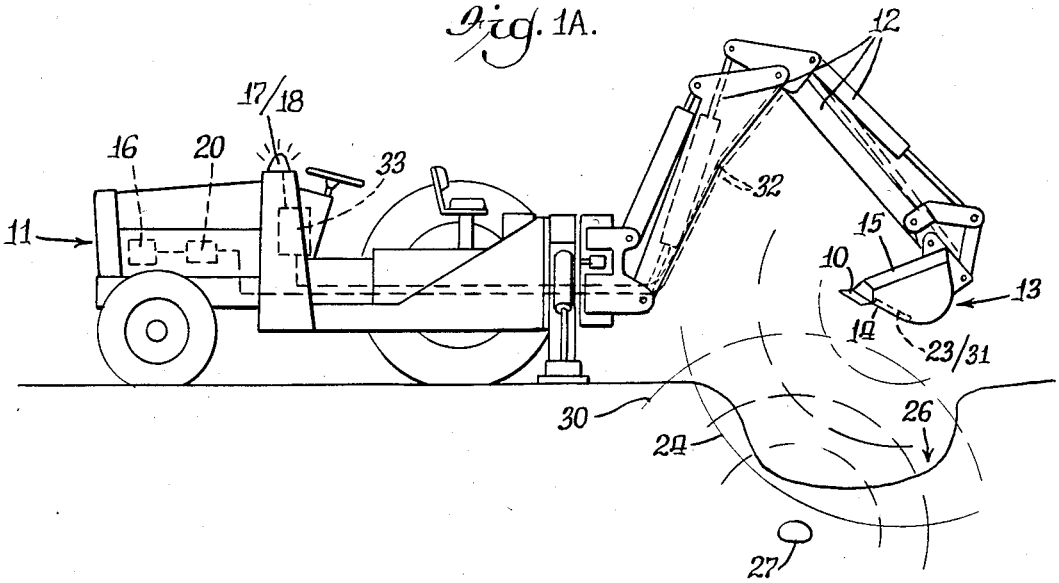
FIG. 1A is a schematic showing of one embodiment of an underground pulsed eddy current detection system wholly mounted on a backhoe according to this invention.
Figure 1B:
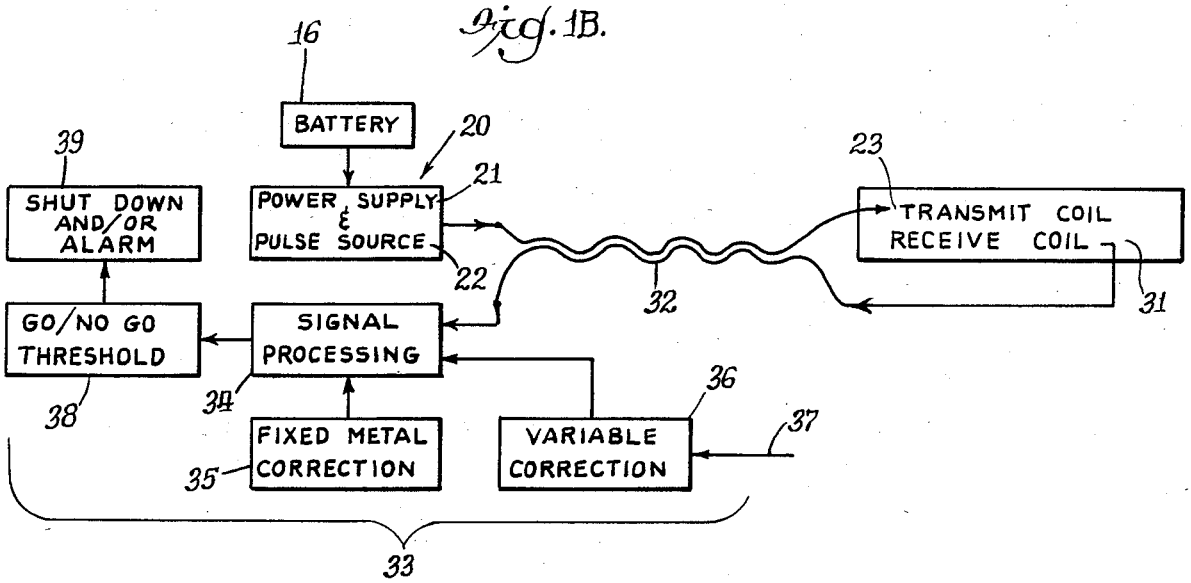
FIG. 1B is a block diagram schematically showing the electronic components of one embodiment of the eddy current detection system this invention.
Figure 9:
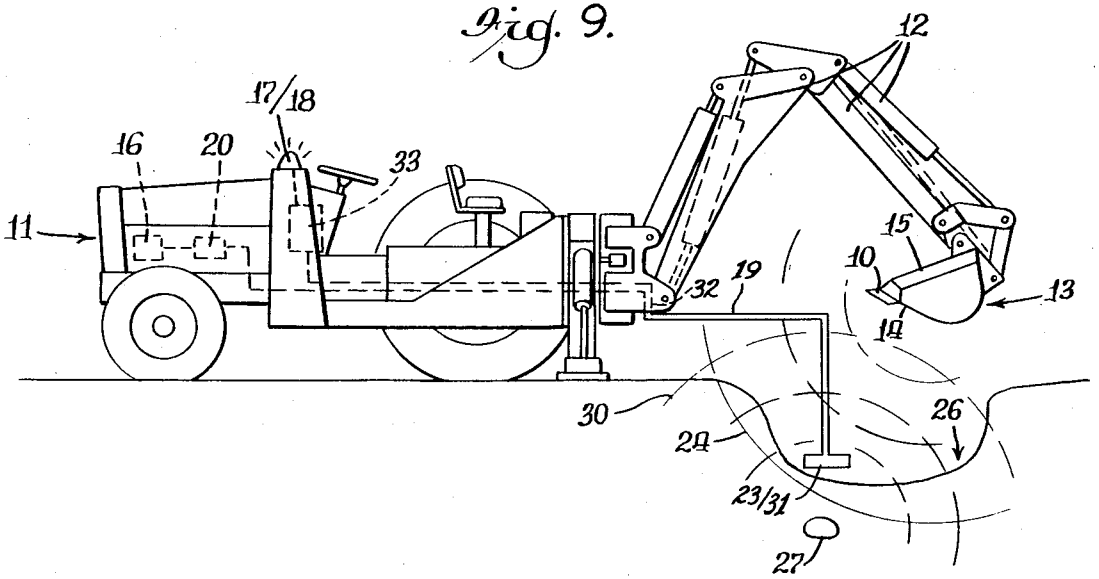
FIG. 9 is a schematic showing one embodiment of an underground pulsed eddy current detection system mounted on a suspended boom.

FIG. 1A shows schematically an apparatus capable of making excavations in the ground and having a wholly contained underground conductive elongated object detector. FIG. 1B shows schematically the electronic components of a pulsed magnetic field transmitter and received eddy current detector according to one embodiment of this invention. Backhoe 11 is shown with movable arms 12 pivotally connected to digging implement bucket 13 having digging face 14 and open entry face 15 with digging teeth 10. Such backhoes are well known to the art and are usually powered by internal combustion engines provided with an electrical energy source system 16, usually comprising a battery and generator or alternator. Electric pulse signal means 20 is powered by electrical energy source system 16 and has power supply 21 and pulse source 22 to provide an electrical pulse signal to transmit coil 23 capable of transmitting a pulsed magnetic transmit field 24 outwardly through ground 25 in the direction of excavation 26 and toward underground pipe 27. A conductive underground pipe 27 induces pulsed eddy currents 30 radiating back toward receive coil 31 mounted in digging face 14 of bucket 13. Eddy currents 30 induce an electrical current in receive coil 31 which is transmitted by armored flexible cable 32 to eddy current electrical signal processing system 33 to determine the presence of the underground conductive object. The decay time of the induced eddy current depends upon the object's geometry, conductivity, and magnetic characteristics. Elongated objects sought to be detected, such as metallic water mains, sewer mains, buried shielded power lines, shielded telephone cables, and other long types of metallic conductors with material and geometry similar to those of steel gas pipes, exhibit a significantly longer decay time than objects of no interest, such as tin cans, which can be clearly discriminated against. An alternative mounting for transmit/receive coils 23/31 is shown in FIG. 9 by extending boom 19 positioning transmit/-receive coils 23/31 alongside digging bucket 13 in its digging position. Transmit/receive coils 23/31 may be lowered into excavation 26 for proximity to the underground volume into which bucket 13 will be digging. This embodiment results in very low interference from any of the excavation apparatus.

Figure 3:
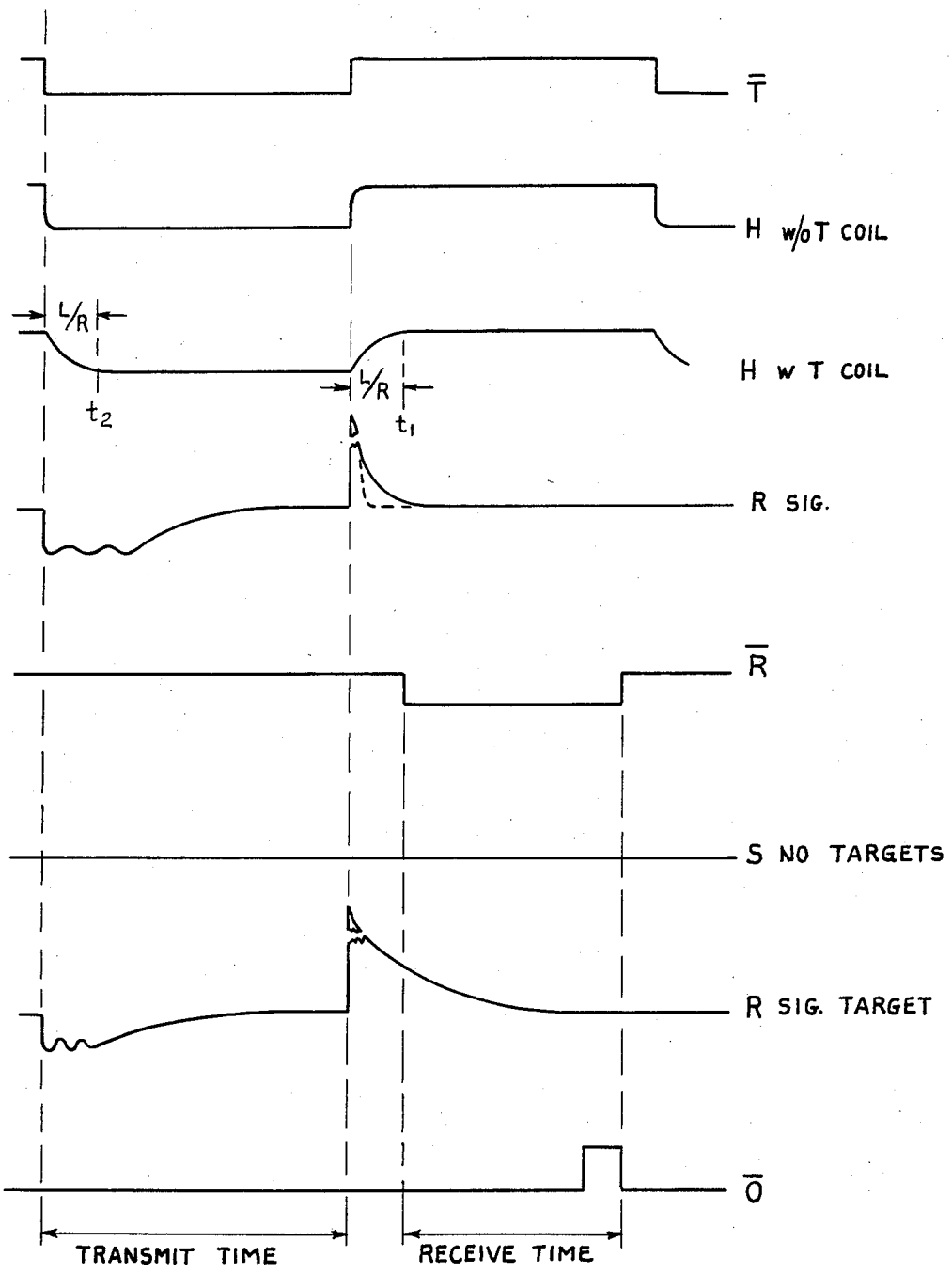
FIG. 3 is a schematic diagram showing the timing logic in one embodiment of this invention.

The magnetic impulse detection discrimination and ranging system of this invention may best be explained by consideration of two circular flat coils coaxially arranged and separated by a distance D. A transmit coil is driven by a current to produce a pulsed magnetic field at the other, target coil, which simulates the buried gas pipe. Referring to FIG. 3, the time function of the pulsed current to the transmit coil is shown by $\overline{T}$. The magnetic waveform that would be present at the target coil if the target coil were absent is shown as a time function as H w/o T coil. If the target coil is present and has an infinite conductivity, such as might be achieved by a super conductor, and if the field is changed in the vicinity of the target loop, currents are induced in the target loop and create fields that oppose the change. Thus the field at the center of the target loop is unchanged despite any time variations in the applied field. Practically, however, this is not the case since most such coils exhibit some finite resistance. The coil current is therefore expected to decay according to the L/R (coil inductance/coil resistance) time constant of the coil, as shown in FIG. 3 as H w T coil. This perturbation in the applied field at the target coil can also be sensed at the transmit coil as well. This can be done simply by monitoring the pickup voltage (the time derivative of the magnetic fields) at the transmit coil, which include those that are rescattered from the target coil. The very high induced voltage arising from the changing current and flux from the transmit coil must be blanked or clipped out in order to observe the rescattered waveforms from the target coil. This is illustrated in FIG. 3, R sig, where the dotted lines illustrate the observed waveforms in the absence of the target coil which might arise from a tin can. The solid line curves illustrate the observed waveforms which would arise due to eddy currents from an elongated pipe.

The effect of the geometry, conductivity, and permeability of the target on the returns can be studied in the simple two coil arrangement described. Both coils would have an inductance as follows:

$$L = r\mu\left[\ln\left(\frac{8r}{a}\right) - 2\right] \text{ henries}$$

and a loop resistance:

$$R = \frac{2\pi r}{\sigma\pi a^2} \text{ ohms}$$

and a time constant:

$$T = L/R = \frac{\mu\left[\ln\left(\frac{8r}{a}\right) - 2\right]\sigma a^2}{2}$$

where $\mu$=effective permeability of media within object
a=radius of conductor
r=radius of loop, cylinder, or sphere
$\sigma$=conductivity of conductor
L=loop inductance
R=loop resistance
d=thickness of thin-walled sphere, cylinder Assuming that both coils have a radius of 0.25 meters, a conductor radius of 0.05 meters, and are made out of copper, the time constant, L/R, would be about 100 milliseconds.

Other objects have different time constant relationships, such as for a thin-walled sphere:

$$T = L/R = \frac{\pi r d\sigma\mu}{3}$$

and for a thin-walled cylinder:

$$T = L/R = \frac{\mu\sigma r d}{2}$$

The spatial distribution of the relative permeability of the media in the vicinity of the coil is also of importance. For example, if a nonconducting ferrite right-circular cylinder ($\sigma=0$, $\mu>>1$) with a radius somewhat smaller than the radius of the target coil is available and centered symmetrically within the target coil and the length of this cylinder is very small compared to its radius, it will not noticeably increase the net flux within the target coil. If however, it is very long, the magnetic flux can be considerably enhanced roughly in proportion to the relative permeability of the ferrite. The relations which describe this interaction are complicated and are generally considered in terms of "the demagnetization factor" or the "effective permeability". These are described as a function of the length-to-radius ratio of the inserted core. A gas pipe is typically ferromagnetic and will exhibit some of the field enhancing properties of the idealized ferrite core. This permeability will lengthen the decay time and thereby make its detection more readily discernible over the returns provided from non-elongated tin cans and other metallic debris.

In a complete system, both positive going and negative going returns could be sensed. Some discrimination between ferromagnetic and nonferromagnetic objects is also possible by modifying the applied waveforms. For example, if the applied field is only reduced to zero and then increased to its original value followed by a complete reversal of opposite sign, the effects of the retained magnetic field on the effective permeability of the pipe can be observed. This does not appear to be a requirement for the system of this invention for backhoe operation.

Referring to the time diagram shown in FIG. 3, $\overline{R}$ shows a suitable receive gate timing sequence. The line S no targets shows the netted received voltage with no object targets. R sig. target shows receive voltage after limiting over a period of the time diagram. $\overline{O}$ shows the time for output of the receive signal integrator to pass to the sample and hold circuit.

The distance of an underground object from the transmit/receive coils of this invention may be determined. Using the same explanation system as above, the time derivative or pickup voltage at the transmit coil is an exponential function of distance as follows:

$$V(x)=Kx^{-n}$$

where

K=is a constant
n=is an exponential constant
V(x)=is the pickup voltage as a function of position x
V'(x)=is the spatial derivative with respect to x To determine the range, the spatial derivative of the pickup with respect to distance may be developed and divided by the observed pickup. The range can then be developed as follows:

$$\frac{V'(x)}{V(x)} = \frac{-n}{x}$$

$$x = \frac{-nV(x)}{V'(x)}$$

The value of n need only be approximately determined in developing the range to the extent that excavation apparatus operations are not terminated too far away from the gas pipe. When the apparent target coil diameter is small compared to the distance between the transmit coil and the target, then the value of n is 6. This is so because the field of the transmit coil falls off as the cube of the distance and the rescattered field also falls off in a similar manner. When one of the coils has a radius much larger than the separation between the coils, then the value of n can take on a smaller value. Based on experimental measurements in the laboratory, we have found the value of n for short gas pipes to be about 4.

When the range must be located more precisely, some form of mapping would be required. The transmit/-receive coils would be drawn across the surface of the volume containing the target in a manner similar to that in which some of the subsurface radars are operated.

The returns would then be integrated and processed to determine the geometry and orientation of the target.

The range equation can be developed knowing the spatial distribution from the transmit coil and the resultant rescattered field spatial distribution as well. For situations using two coils as described, the range equation is as follows:

$$D = (r_1)\left[\frac{H(O, t_2)(3\tau)^{1/2}}{H_n(1)(S/N)}\right]^{1/6}$$

where

D = the range to a similar coil in meters $r_1$ = the radius of transmit and target coils H (O, $t_2$) = the field at the transmit loop just after a change in A/m $\mu$ = the integration time in seconds $H_n$ (1) = the magnetic field intensity noise in A/m−(f)$^{\frac{1}{2}}$ for 1 Hertz bandwidth (S/N) = the minimum acceptable signal-to-noise ratio The dominant factor in determining the range is the radius of the coil. Other factors such as the amplitude of the transmit field, integration time, amplitude of the noise field, and the required signal-to-noise ratio, affect the range to a lesser degree since these factors are reduced by the 1/6th or 1/12th power. By substituting suitable values based upon experimental studies to date, a range greater than 5 meters for transmit/receive coils having a diameter of about one-half of a meter seems reasonable.

If the target is a long gas pipe, instead of the target coil as described above, then the rescattered fields from the target do not necessarily fall off as inversely proportional to the cube of the distance. This will allow increased range and the range equation may be somewhat altered (the 1/6th power would be increased to the 1/4th). It therefore appears theoretically possible to extend the range of the system of this invention to detect deeply buried (about 25 meters deep) gas pipes if this were to be a requirement. The objective of the magnetic impulse detection discrimination and ranging system of this invention, however, is to avoid detection of the more distant targets; this can be done by limiting the range of the system by both sensitivity and geometric adjustments.

From the above, it is seen that when the target object of the transmit magnetic pulses is very long relative to its diameter, such as an elongated conductive pipe, the interaction with the magnetic pulses with a ferro magnetic gas pipe exhibits the field-enhancing properties of a ferrite coil and will lengthen the decay time of induced eddy currents and make their detection readily discernable over return signals from tin cans and other metallic debris. The magnetic impulse detection discrimination and ranging system of this invention relies upon near-field scattering that allows inherent discrimination between the desired pipelines and tin cans. The system of this invention purposely is of limited range to permit use of the near field of coils in the quasi-static region and to permit excavation in close proximity to adjacent pipes without signalling or shutting down the excavation apparatus. The detected wave form and signal processing is also different from many other detection systems in that the detected wave form and signal processing are in the millisecond range, whereas many other detection systems require microsecond or nanosecond signal processing. The system of this invention uses a pulsed magnetic field with a decay time which is small compared to the L/R time constant of the coil, generally less than about 100 microseconds and greater than about 4 microseconds, preferably about 20 to about 40 microseconds with the induced eddy current decay time of at least five times the pulsed magnetic transmit field. The transmit pulse repetition or cycle time should be high with respect to the L/R time constant of the target, generally greater than about 1 millisecond and less than about 1 second. Thus, undesired signals can be easily eliminated by time gating circuits and zero mutual coupling between the transmit coil and the sensing coils is not necessary, as in prior eddy current detectors.

Eddy current electrical processing system 33 has a signal processing circuit 34 in which electronic corrections may be applied to compensate for fixed metal on bucket 13 by application of a compensating signal to signal processing circuit 34 from fixed metal correction circuit 35. Variable correction circuit 36 may be used to compensate for the variable positions of metal on the movable arms 12 with respect to the pulsed eddy current receive coil 31 by a sensor signal 37 being supplied from sensors on the movement controls or on the movable arms. The output signal from signal processing circuit 34 is fed to threshold circuit 38 which provides a signal to shut down and/or alarm circuit 39 when eddy current receive coil 31 is within a preset distance from underground conductive pipe 27. A signal from shut down and/or alarm circuit 39 may be used to automatically stop operation of the excavation apparatus, and/or may activate audible alarm 17 and/or visual alarm 18.

Figure 2:
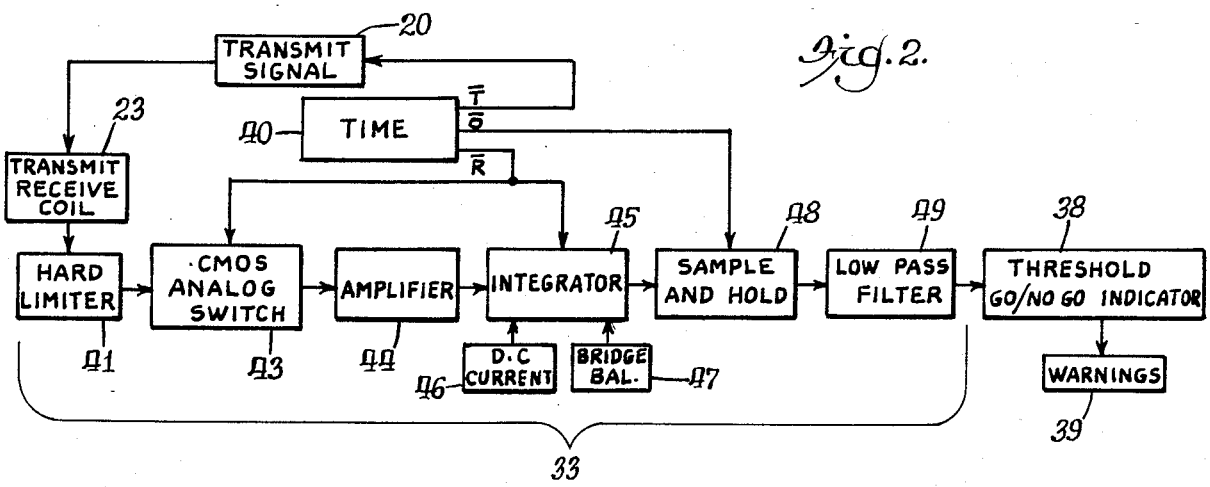
FIG. 2 is a block diagram schematically showing the circuit logic for signal processing in one embodiment of the invention.

FIG. 2 shows in more detail in block diagram form the electronic logic of the system and the components of one embodiment of the eddy current electrical processing system 33. Time circuit 40 provides the trigger signal for the transmit electric pulse signal system 20 and time controls eddy current electrical processing system 33. A suitable timing diagram is shown in FIG. 3. Electric pulse signals are supplied to transmit coil 23 when signal $\overline{T}$ goes low and the receive signal is blanked except when $\overline{R}$ goes low. The signal $\overline{O}$ due to the underground conductive pipe is shown in the terminal portion of the receive time span. The signal from receive coil 31 is passed through hard limiter 41 to CMOS analog switch 43 which provides time gating required to reject receive coil signals with short decay times. After gating, the eddy current electrical signal is amplified by amplifier 44 and integrated by integrator circuit 45. The integrator is reset after each receive interval, when $\overline{R}$ goes high, and the output of the integrator fed to sample and hold circuit 48 during the time $\overline{O}$ shown in FIG. 3. Integrator 45 may be provided with a constant correction current supplied by D.C. current supply 46 and/or a variable correction current by bridge balance 47 to reduce the signal fluctuation caused by noise and to provide improved sensitivity for the object signal. The output of sample and hold circuit 48 provides a direct current level through low pass filter 49 to threshold circuit 38 for comparison to an adjustable threshold level to provide a go/no-go signal. The go signal is supplied to shut off to excavation apparatus or to acuate any desired signal. The above description of time gating logic and desired results from the individual electronic components will permit one skilled in the art to provide the electronic components which are all known to the art. Processing of signals in the millisecond range and the large signal discrimination inherent in the method itself greatly simplifies the electronic processing requirements and results in sturdy, compact electronics capable of withstanding bumping and jarring normally encountered in earth excavation equipment.

Placement of transmit coil 23 and receive coil 31 in the movable digging implement portion of the excavation apparatus is especially desired to place the coils the furthest possible distance from metallic interference due to the rest of the excavation apparatus while placing the coils in closest proximity to the underground object sought to be detected. We have found that the range of effectiveness of the transmit and receive coils for detection of an underground object is largely determined by the radius of eddy current receive coil 31 and is relatively insensitive to other variations. A suitable coil radius of about 12 inches provides operational ranges limited to a few feet so that backscattered returns from the main body of the excavation apparatus and adjacent parallel piping or cables minimally influence the detection process. Mounting of transmit coil 23 and receive coil 31 in the bucket may be achieved in several ways, the coils may be emplaced in digging face 14 and/or entry face 15 dependent upon the manner in which the bucket is used and the geometric relationship of the underground object to the bucket while in use.

In many applications it is desirable to have multiple coils at different orientations. The use of two receive coils at different orientations would eliminate any null regions which may occur due to the geometry of the underground pipe with respect to a single receive coil. Further, when two receive coil positions are used, either the variation in return signal with distance or the divergence of the eddy current field can be measured and used to estimate the distance to the underground object. Another method for ascertaining the distance from the excavator bucket to the underground pipe is to ascertain the receive signal for two different distances of the bucket to the pipe and the distance the single receive coil moved between the two measurements may be ascertained by sensors placed on the backhoe arm or the arm controls.

Figure 7:
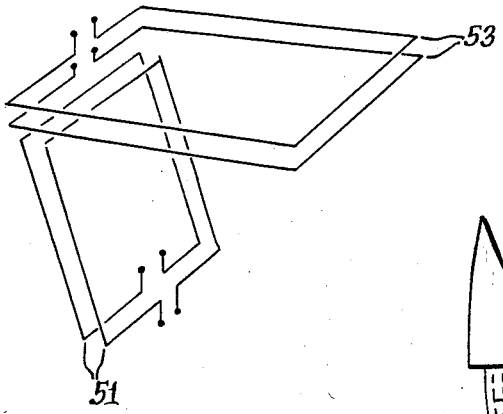
FIG. 7 schematically shows a multiple coil gradiometer for an excavator bucket in accordance with another embodiment of this invention.

FIG. 7 shows entry face transmit/receive coils 53 and digging face transmit/receive coils 54 in the geometric relationship they would be when mounted in the entry face and digging face, respectively, of an excavating implement to form a partial gradiometer. This geometry provides desired ranging function.

Figure 8:
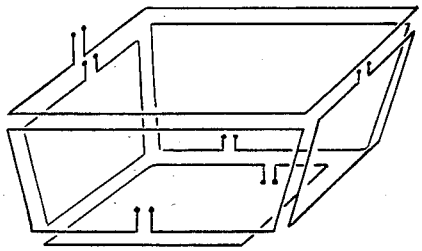
FIG. 8 schematically shows a three-vector gradiometer in accordance with another embodiment of this invention.

FIG. 8 shows the configuration for a three-vector gradiometer with a transmit/receive coil mounted in each face of the digging implement bucket. The orthogonal positions of the different coils receiving different signals due to varying distance from the underground pipe permits detection of direction of the underground pipe with respect to the excavation digging implement bucket. FIG. 8 shows digging face coils 55, entry face coils 56, side face coils 57 and 59, back face coils 58, and bottom coils 60 to form a three-vector gradiometer configuration suitable for incorporation into a digging implement.

Several methods may be used for mounting the transmit and receive coils in the excavator digging implement, such as a bucket, since an appropriate radius of the coils can be about 1 foot to deliberately limit the operational range to 2 to 4 feet. Mounting of the coils in the bucket provides assured detection of the underground pipe in sufficient time to avoid damage to the pipe and to eliminate competing returns from the backhoe arm and adjacent piping. The coils may be emplaced in the closed digging face of the bucket or surrounding the open entry face of the bucket. Several methods may be used to suppress eddy currents formed by the bucket and cause competing returns which obscure detection of the desired eddy current returns from an underground pipe: conductive metal buckets may be modified so as to reduce eddy current paths; metal buckets may be fabricated from a metal which is nonmagnetic and a poor conductor; the effect of the eddy currents from the bucket may be electronically balanced in the eddy current electrical processing system; or a major portion of the bucket may be made from non-metallic material such as a fiber-reinforced-plastic.

Figure 4:
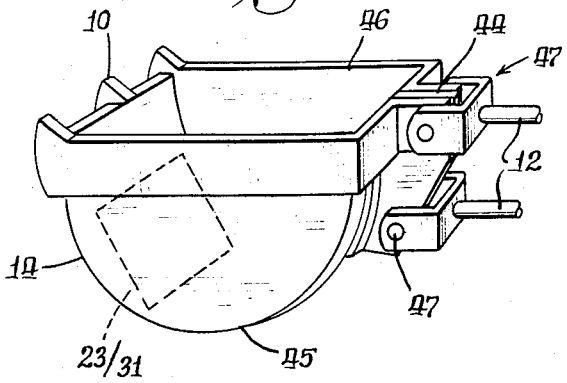
FIG. 4 shows transmit/receive coils within a non-conductive excavator bucket in accordance with one embodiment of this invention.

FIG. 4 shows fiber reinforced plastic bucket 45 with metal frame entry face 46 and teeth 10. Transmit/-receive coils 23/31 are mounted on the inner surface of digging face 14 of the reinforced plastic bucket. Entry face metal frame 46 is desirably interrupted by insulator 44 and connected to movable arms 12 through insulated pivotal joints of 47. The combined metal, fiber-reinforced-plastic bucket shown in FIG. 4 is especially suitable for use in the present invention since the metal frame entry face 46 provides the main mechanical strength in the bucket while digging and the reinforced plastic bucket portion 45 encounters lower stresses in the digging operation and provides no interference for the transmit/receive coils. Metal teeth 10 can be incorporated in the entry face metal frame in a replaceable manner to allow replacement of worn teeth and since the size of the teeth is small compared with the overall dimension of the pipes to be detected, the eddy currents induced by the teeth have a shorter time decay period. We have found that the strength of a combined metal, fiber-reinforced-plastic bucket and its wear characteristics are suitable for normal excavation procedures.

Figure 5:
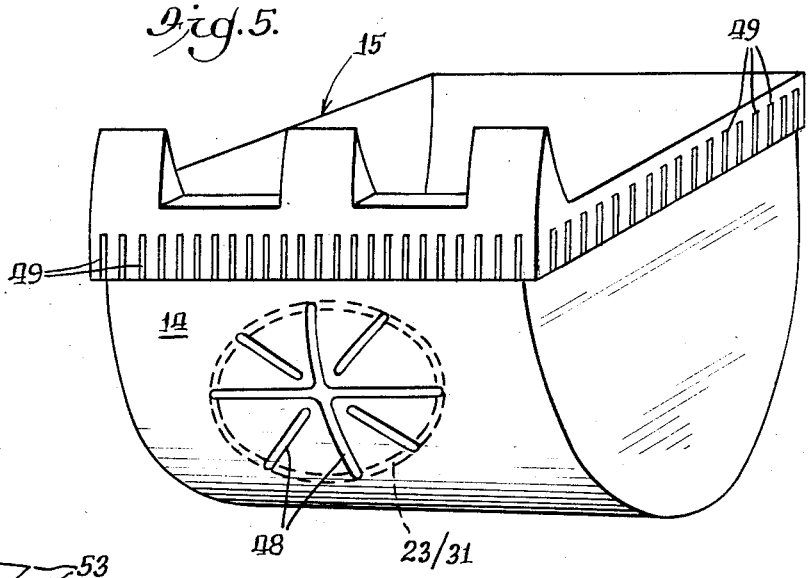
FIG. 5 shows transmit/receive coils installed in a metallic excavator bucket in accordance with yet another embodiment of this invention.

FIG. 5 shows an embodiment of this invention incorporating transmit/receive coil 23/31 in digging face 14 of an entirely metal bucket with slots 48 through the metal digging face and interruption slots 49 around the heavy metal entry face frame 15 to reduce to a very short time constant the decay values of eddy currents induced by the heavy metal portions of the all metal bucket.

Figure 6:
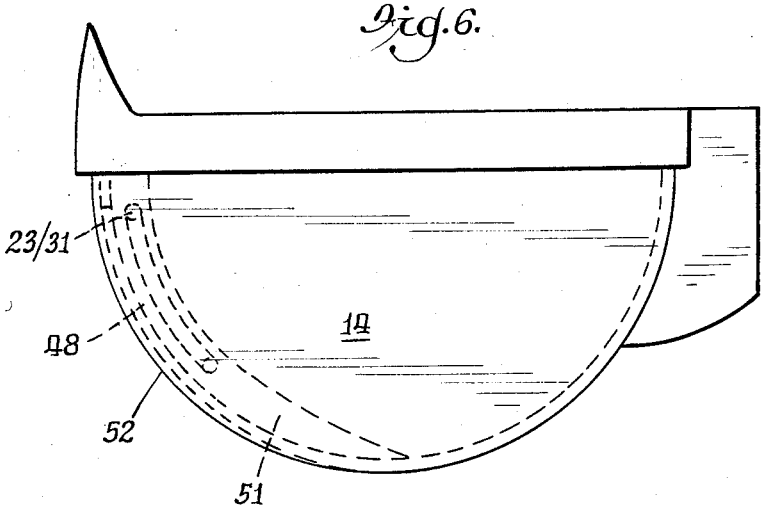
FIG. 6 shows covered transmit/receive coils in an excavator bucket in accordance with another embodiment of this invention.

FIG. 6 shows that digging face 14 with slots 48 and transmit receive coil 23/31 may be covered on the outside with outer slot cover 52 and on the inner side with inner coil cover 51. Inner coil cover 51 and outer slot cover 52 may be fabricated from fiber reinforced plastics and may be used with any of the above described embodiments of the invention.

Operation of an excavation apparatus with extended boom 19 supporting transmit/receive coils 23/31 as shown in FIG. 1A may use the same electronic apparatus and processes as described above with respect to installation of the transmit/receive coils in the digging bucket.

The following specific Examples are set forth in detail to illustrate specific embodiments of the invention and should not be considered to limit the invention in any manner.

EXAMPLE I

A plywood box 6 feet long, 3 feet wide and 30 inches high was constructed having an open top and a smaller plywood open top box 18 inches high, 14 inches wide and 30 inches long was placed in the mid-width region of one side, the upper edges of the sides of the two boxes flush. The smaller plywood box simulated an excavated volume and provided space for the transmit and receive coils. A plastic tube was placed through the larger box with open ends to the exterior of the box, 15 inches from the bottom and 12 inches from and parallel to the inner wall of the smaller box. The larger box was filled with dry clay. A transmit coil and receive coil were mounted in the smaller box parallel to the plastic tube. A power supply fed a switching circuit that allowed up to one ampere current to be pulsed through the circular transmit coil having a 1.0 foot diameter with 48 turns of Litz wire 18 gauge equivalent with taps every 6 turns. A pulse generator provided a trigger signal to turn the transmit coil current on and off with pulses having a 0.01 second repitition rate and 50 percent duty cycle. The receive coil was 1.0 foot square with 46 turns of 22 gauge copper wire and was critically damped to provide a quick decay time without ringing. The output of the receive coil was hard limited and observed on an oscilloscope. When the transmit coil was turned off, a voltage spike was observed with a 30 microsecond decay time constant. After decay of the transmit coil spike, the portion of the receive coil output wave form was determined for various conductive objects placed in the plastic tube and the following were the decay time constants of induced pulsed eddy current:

| | | Receive Signal Decay Time Constant (microseconds) |
|---|---|---|
| No object | | 30 |
| Steel Gas Pipe | 1" O.D. | 350 |
| Steel Gas Pipe | 3½" O.D. | 475 |
| Steel Gas Pipe | 4½" O.D. | 550 |
| Steel Stove Pipe | 4" O.D. | 140 |
| Tin Can | Approx. | 30 |

The above results show the determination of the presence and the ability to estimate size of the underground gas pipe while clearly discriminating from other underground conductive objects.

EXAMPLE II

The same test arrangements as described in Example I were used with different transmit and receive coils and electronics.

The transmit and receive coils were made of plastic pipe in a form 14 inches square and wound with 50 turns of 20 gauge copper wire. A transistor switching circuit comprising a power MOSFET (IRF 350) capable of handling a continuous drain current of 11 amps and a maximum drain-to-source voltage of 400 volts was used to provide up to 4 amps to the transmit coil. The receive signal waveforms were viewed on an oscilloscope and different objects were placed in the plastic tube resulting in clear differentiation of desired objects as follows:

| | | Receive Signal at 5 milliseconds Net Value (MV) |
|---|---|---|
| Steel Gas Pipe | 1" O.D. | 3 |
| Steel Gas Pipe | 3½" O.D. | 15 |
| Steel Gas Pipe | 4½" O.D. | 23 |
| Lead Pipe | 2½" O.D. | 6.5 |
| Copper Pipe | 2" O.D. | 2.5 |
| Steel Stove Pipe | 4" O.D. | 5.0 |

-continued

| | | Receive Signal at 5 milliseconds Net Value (MV) |
|---|---|---|
| Tin Can | | 0 |

Signal discrimination enabling detection and sizing of underground elongated conductive pipes is clearly shown.

EXAMPLE III

The same test arrangements, transmit and receive coils and switching circuit as described in Example II were used with a receive signal processing circuit as shown in FIG. 2 to process the receive signal and to provide the trigger signal for the transmit coil switching circuit. The receive coil output was hard limited by two diodes to ±0.6 volts and the limited receive signal passed through a CMOS analog switch to provide time gating to reject eddy current responses with short decay times. After gating, the receive signal was amplified and integrated. The integrator was reset after each receive interval and the integrated valve put through a sample and hold circuit. The output of the sample and hold circuit provided a D.C. level which was compared to an adjustable threshold level to provide a go/no-go signal. The D.C. output voltage level of the receive signal processing circuit was used as the measurement for tests performed with different objects in the plastic tube. In the first series the dry clay as described in Example I was used and in the second series 10 percent water by weight was added to the clay to provide moist clay measurements:

| | | Receive Signal Processing Circuit D.C. Voltage Output | |
|---|---|---|---|
| | | Dry Clay | Moist Clay |
| No object | | −0.2 | −0.05 |
| Steel Gas Pipe | 1" O.D. | 0.5 | 0.51 |
| Steel Gas Pipe | 3½" O.D. | 2.2 | 2.6 |
| Steel Gas Pipe | 4½" O.D. | 3.1 | 3.7 |
| Lead Pipe | 2½" O.D. | 0.4 | 0.6 |
| Copper Pipe | 2" O.D. | 0.3 | 0.4 |
| Steel Stove Pipe | 4" O.D. | 0.1 | 0.015 |

Again, the clear discrimination against lightweight stove pipes and permitting desired detection of elongated underground conductive pipes with relatively simple time gated electronics has been shown.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An apparatus capable of making excavation in the ground in combination with a fully contained underground elongated conductive object detector comprising:

a transmit and receive means capable of locating an underground elongated conductive object in the proximity of said excavation mounted in a digging implement comprising a metal bucket, said transmit and receive means installed on the inside of the digging face of said bucket, said digging face having a multiplicity of through slots covered with non-conducting material in the vicinity of said transmit and receive means, and the edges of a heavy metal entry face frame having multiple interruption slots reducing the time value decay constants of induced eddy currents;

means for providing an electric pulse signal to said transmit means, said transmit means capable of transmitting a pulsed magnetic transmit field outwardly through the ground in the direction of said excavation;

said receive means capable of receiving eddy currents induced by said underground conductive object contacted by said pulsed magnetic transmit field and transmitting an electrical signal proportionate to said eddy currents;

said pulsed magnetic transmit field having decay times substantially less than said eddy current decay time;

means for electronically processing said eddy current electrical signal to determine the presence of said underground conductive object.

2. An apparatus capable of making excavation in the ground in combination with a fully contained underground elongated conductive object detector comprising:

a transmit and receive means capable of locating an underground elongated conductive object in the proximity of said excavation mounted in a digging implement comprising a non-conductive polymeric bucket portion, said transmit and receive means installed on the inside of the digging face of said bucket body;

means for providing an electric pulse signal to said transmit means, said transmit means capable of transmitting a pulsed magnetic transmit field outwardly through the ground in the direction of said excavation;

said receive means capable of receiving eddy currents induced by said underground conductive object contacted by said pulsed magnetic transmit field and transmitting an electrical signal proportionate to said eddy currents;

said pulsed magnetic transmit field having decay times substantially less than said eddy current decay time;

means for electronically processing said eddy current electrical signal to determine the presence of said underground conductive object.

3. An apparatus according to claim 2 wherein said bucket body has a metallic frame around its open entry face and the edges of said frame has multiple interruption slots reducing the time constant decay values of induced eddy currents.

4. An apparatus according to claim 2 wherein said bucket portion is provided with a metal entry face frame interrupted by an insulator to decrease interference with said transmit and receive means installed therein.

5. A process for detection of underground elongated conductive objects during excavation with an excavation apparatus having a fully contained underground elongated conductive object detector, said process comprising the sequential steps:

providing an electrical pulse signal, powered by a power source of said excavation apparatus, to a transmit coil mounted in a digging implement comprising a metal bucket having said transmit and receive means installed on the inside of the digging face of said bucket, said digging face having a multiplicity of through slots covered with non-conducting material in the vicinity of said transmit and receive means, the edges of a heavy metal entry face frame having multiple interruption slots reducing the time constant decay values of induced eddy currents, said transmit coil forming a pulsed magnetic transmit field;

transmitting said pulsed magnetic transmit field outwardly through the ground in the direction of said excavation;

receiving in a receive coil mounted in said digging implement pulsed eddy currents induced by said underground elongated conductive object contacted by said pulsed magnetic field;

converting said pulsed eddy currents into an electrical pulse signal proportionate to said eddy currents, said eddy currents having a decay time at least five times as long as the decay time of said pulsed magnetic transmit field;

electronically processing said eddy current electrical signal to determine the presence of said underground elongated conductive object.

6. A process for detection of underground elongated conductive objects during excavation with an excavation apparatus having a fully contained underground elongated conductive object detector, said process comprising the sequential steps:

providing an electrical pulse signal, powered a power source of said excavation apparatus, to a transmit coil mounted in a digging implement comprising a non-conductive polymeric bucket body portion having said transmit and receive means installed on the inside of the digging face of said bucket body, said transmit coil forming a pulsed magnetic transmit field;

transmitting said pulsed magnetic transmit field outwardly through the ground in the direction of said excavation;

receiving in a receive coil mounted in said movable appendage pulsed eddy currents induced by said underground elongated conductive object contacted by said pulsed magnetic field;

converting said pulsed eddy currents to an electrical pulse signal proportionate to said eddy currents, said eddy currents having a decay time at least five times as long as the decay time of said pulsed magnetic transmit field;

electronically processing said eddy current electrical signal to determine the presence of said underground elongated conductive object.

7. The process of claim 6 wherein said bucket body has a metallic frame around its open entry face and the edges of said frame has multiple interruption slots reducing the time constant decay values of induced eddy currents.

8. The process according to claim 6 wherein said bucket portion is provided with a metal entry face frame interrupted by an insulator to decrease interference with said transmit and receive means installed therein.

9. An apparatus capable of making excavation in the ground in combination with a fully contained underground elongated conductive object detector comprising:

a transmit and receive means capable of locating an underground elongated conductive object in the proximity of said excavation mounted in a digging implement comprising a fiber-reinforced-plastic bucket with a metal frame entry face, said transmit and receive means installed on the inside of the digging face of said bucket, and said metal frame entry face interrupted by an insulator to decrease interference with said transmit and receive means;

means for providing an electric pulse signal to said transmit means, said transmit means capable of transmitting a pulsed magnetic transmit field outwardly through the ground in the direction of said excavation;

said receive means capable of receiving eddy currents induced by said underground conductive object contacted by said pulsed magnetic transmit field and transmitting an electrical signal proportionate to said eddy currents;

said pulsed magnetic transmit field having decay time substantially less than said eddy current decay time;

means for electronically processing said eddy current electrical signal to determine the presence of said underground conductive object.

10. A process for detection of underground elongated conductive objects during excavation with an excavation apparatus having a fully contained underground elongated conductive object detector, said process comprising the sequential steps:

providing an electrical pulse signal, powered by a power source of said excavation apparatus, to a transmit coil mounted in a digging implement comprising a fiber-reinforced-plastic bucket body portion with a metal frame entry face having said transmit and receive means installed on the inside of the digging face of said bucket body, said transmit coil forming a pulsed magnetic transmit field;

transmitting said pulsed magnetic transmit field outwardly through the ground in the direction of said excavation;

receiving in a receive coil mounted in said digging implement pulsed eddy currents induced by said underground elongated conductive object contacted by said pulsed magnetic field;

decreasing interference of said metal frame entry face with said transmit and receive means by providing an insulator interrupting said metal frame entry face;

converting said pulsed eddy currents to an electrical pulse signal proportionate to said eddy currents, said eddy currents having a decay time at least five times as long as the decay time of said pulsed magnetic transmit field;

electronically processing said eddy current electrical signal to determine the presence of said underground elongated conductive object.

* * * * *